US010920537B2

(12) United States Patent
Sessa et al.

(10) Patent No.: US 10,920,537 B2
(45) Date of Patent: Feb. 16, 2021

(54) SHROUD ASSEMBLY

(71) Applicant: Weatherford Technology Holdings, LLC, Houston, TX (US)

(72) Inventors: Michael Joseph Sessa, Houston, TX (US); Scott Crowley, Houston, TX (US); Jason Brasseaux, Cypress, TX (US); Joshua Hornsby, Tomball, TX (US); Chris Hall, Cypress, TX (US); James Reginald Boggs, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 272 days.

(21) Appl. No.: 15/951,923

(22) Filed: Apr. 12, 2018

(65) Prior Publication Data

US 2018/0298730 A1 Oct. 18, 2018

Related U.S. Application Data

(60) Provisional application No. 62/484,884, filed on Apr. 12, 2017.

(51) Int. Cl.

| | |
|---|---|
| ***E21B 41/00*** | (2006.01) |
| ***E21B 43/04*** | (2006.01) |
| ***E21B 17/046*** | (2006.01) |
| ***E21B 17/18*** | (2006.01) |
| ***E21B 47/017*** | (2012.01) |

(52) U.S. Cl.

CPC ..... *E21B 41/00* (2013.01); *E21B 17/046* (2013.01); *E21B 17/18* (2013.01); *E21B 43/045* (2013.01); *E21B 47/017* (2020.05)

(58) Field of Classification Search

CPC ..... E21B 43/08; E21B 43/04; E21B 41/0078

See application file for complete search history.

(56) References Cited

U.S. PATENT DOCUMENTS

| | | | |
|---|---|---|---|
| 5,390,966 | A | 2/1995 | Cox et al. |
| 6,409,219 | B1 | 6/2002 | Broome et al. |
| 7,493,959 | B2 | 2/2009 | Johnson et al. |
| 7,828,056 | B2 | 11/2010 | Dybevik et al. |
| 8,347,956 | B2 | 1/2013 | Yeh et al. |
| 8,783,348 | B2 | 7/2014 | Edwards et al. |
| 8,789,611 | B2 | 7/2014 | Greci et al. |
| 8,794,338 | B2 | 8/2014 | Greci et al. |

(Continued)

FOREIGN PATENT DOCUMENTS

| | | | | |
|---|---|---|---|---|
| GB | 2488290 | A | 8/2012 | |
| WO | WO-2010047708 | A1 * | 4/2010 | ..... E21B 37/00 |
| WO | 2016144301 | A1 | 9/2016 | |

OTHER PUBLICATIONS

International Search Report and Written Opinion in related application PCT/US2018023232 dated Jun. 7, 2018.

(Continued)

*Primary Examiner* — Tara Schimpf
*Assistant Examiner* — Dany E Akakpo
(74) *Attorney, Agent, or Firm* — Patterson + Sheridan, LLP

(57) ABSTRACT

A shroud assembly having two semi-cylindrical covers having a connector at each end; a plurality of receiver rings for supporting the covers and engaging the connector; and an extender ring configured to move a first receiver ring toward a second receiver ring.

15 Claims, 12 Drawing Sheets

(56) References Cited

U.S. PATENT DOCUMENTS

| | | | | |
|---|---|---|---|---|
| 8,807,205 | B2 | 8/2014 | Cunningham | |
| 8,893,789 | B2 | 11/2014 | Cunningham et al. | |
| 8,967,240 | B2 | 3/2015 | Cunningham et al. | |
| 9,074,458 | B2 | 7/2015 | Cunningham et al. | |
| 2013/0327542 | A1 | 12/2013 | Least et al. | |
| 2014/0158373 | A1 | 6/2014 | Least et al. | |
| 2014/0262208 | A1 | 9/2014 | Cunningham et al. | |
| 2015/0136391 | A1 | 5/2015 | Cunningham et al. | |
| 2015/0192008 | A1* | 7/2015 | Dikshit | E21B 47/1015 166/250.12 |
| 2015/0233216 | A1 | 8/2015 | Rodrigue et al. | |
| 2015/0240572 | A1 | 8/2015 | Vu | |
| 2015/0345257 | A1 | 12/2015 | Veit | |
| 2015/0361765 | A1 | 12/2015 | Lopez et al. | |
| 2017/0058647 | A1 | 3/2017 | Langlais | |
| 2018/0334861 | A1* | 11/2018 | Greci | E21B 17/046 |

OTHER PUBLICATIONS

Partial International Search Report in related application PCT/US2018/027235 dated Jul. 27, 2018.

International Search Report and Written Opinion in related application PCT/US2018/027235 dated Sep. 19, 2018.

EAP Office Action dated Sep. 25, 2020, for Eurasian Patent Application No. 201992412.

* cited by examiner

SHROUD ASSEMBLY

BACKGROUND OF THE INVENTION

Production of hydrocarbons from loose, unconsolidated, and/or fractured formations often produces large volumes of particulates along with the formation fluids. These particulates can cause a variety of problems. For this reason, operators use gravel packing as a common technique for controlling the production of such particulates.

To gravel pack a completion, a screen is lowered on a workstring into the wellbore and is placed adjacent the subterranean formation. Particulate material, collectively referred to as "gravel," and a carrier fluid, is pumped as slurry down the workstring. Eventually, the slurry exits through a "cross-over" into the wellbore annulus formed between the screen and the wellbore.

The carrier fluid in the slurry normally flows into the formation and/or through the screen. However, the screen is sized so that gravel is prevented from flowing through the screen. This results in the gravel being deposited or "screened out" in the annulus between the screen and the wellbore to form a gravel-pack around the screen. Moreover, the gravel is sized so that it forms a permeable mass that allows produced fluids to flow through the mass and into the screen but blocks the flow of particulates into the screen.

Due to poor distribution of the gravel, it is often difficult to completely pack the entire length of the wellbore annulus around the screen. This can result in an interval within the annulus that is not completely gravel packed. The poor distribution of gravel is often caused by the carrier liquid in the slurry being lost to more permeable portions of the formation. Due to the loss of the carrier liquid however, the gravel in the slurry forms "sand bridges" in the annulus before all of the gravel has been placed around the screen.

Such bridges block further flow of the slurry through the annulus, thereby preventing the placement of sufficient gravel below the bridge in top-to-bottom packing operations or above the bridge in bottom-to-top packing operations. Alternate flow conduits, called shunt tubes, can alleviate this bridging problem by providing a flow path for the slurry around such sand bridges. The shunt tubes are typically run along the length of the screen and are attached to the screen by welds.

There is a need for a shroud assembly to protect the jumper tube connection assembly.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
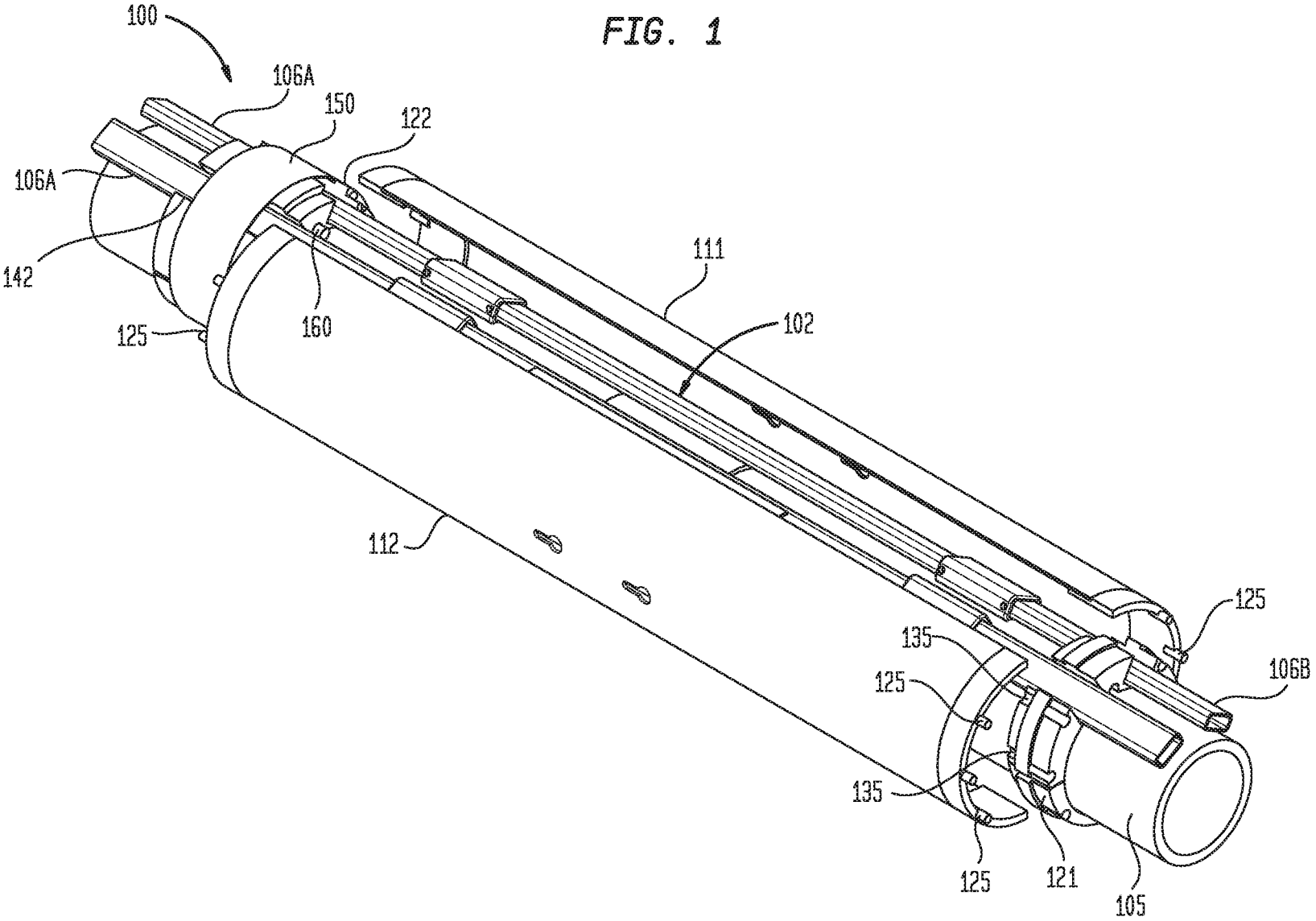
FIG. 1 illustrates an exemplary embodiment of a shroud assembly.
Figure 2:
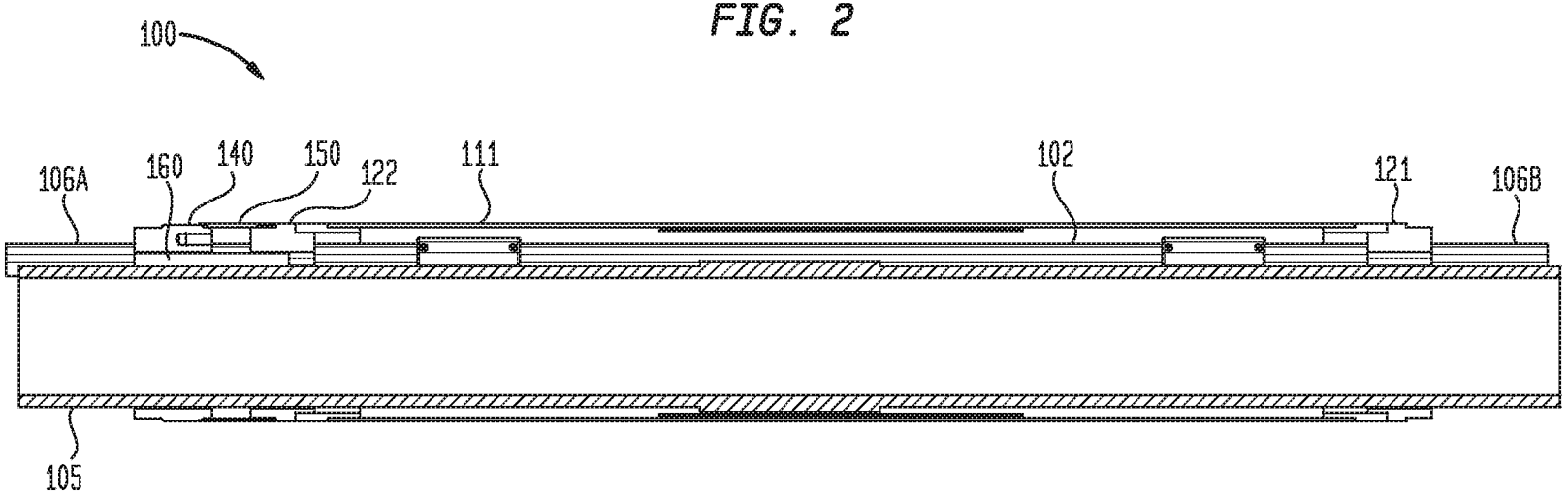
FIG. 2 is a cross-sectional view of the shroud assembly of FIG. 1.
Figure 3:
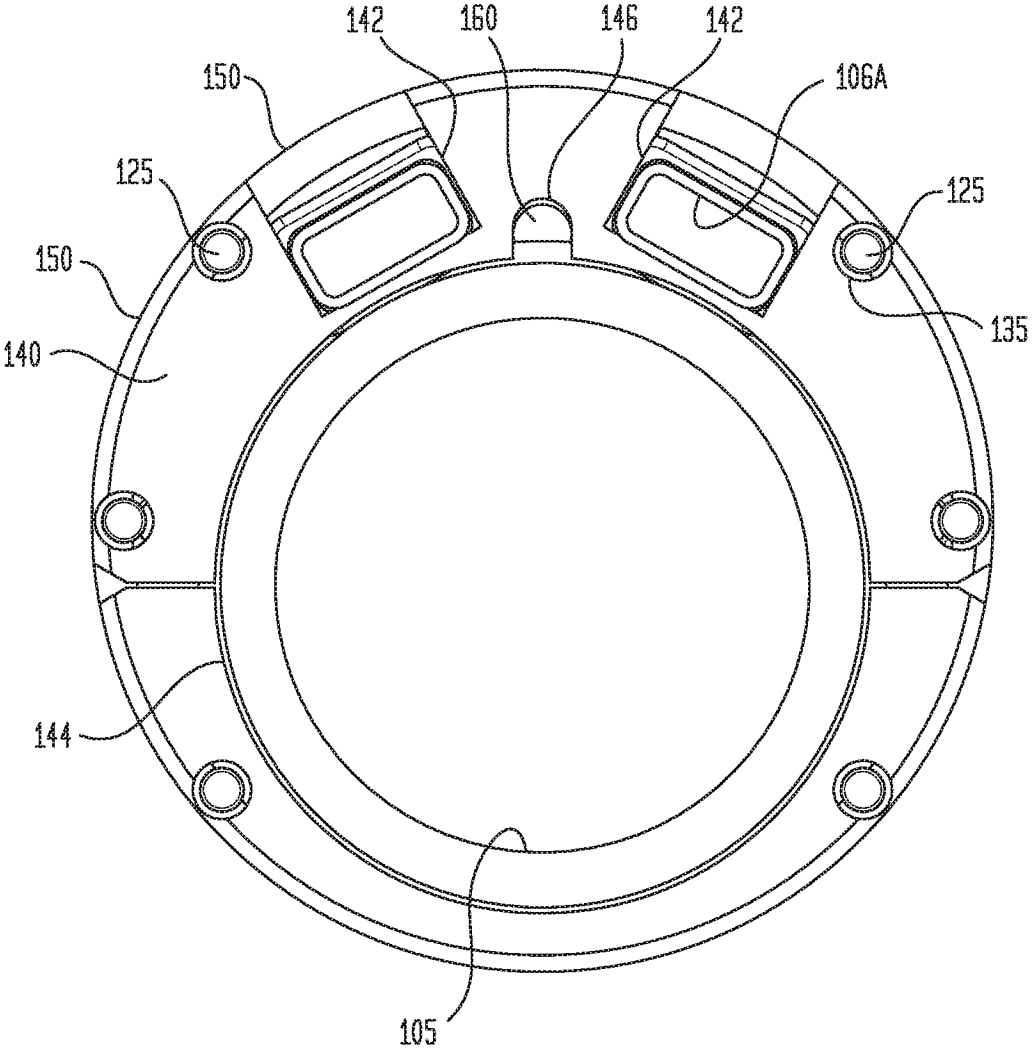
FIG. 3 is an end view of the shroud assembly.
Figure 5:
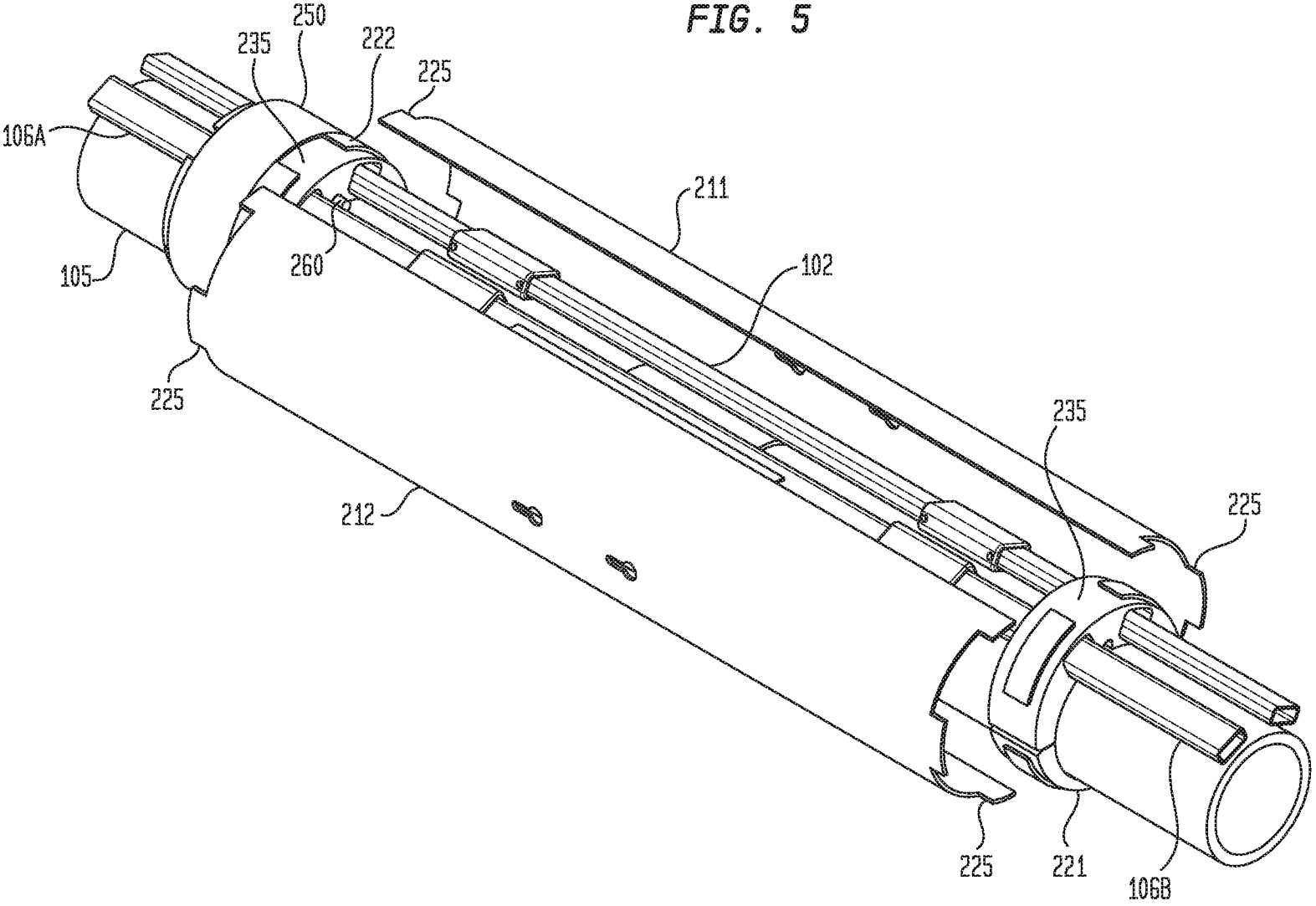
FIG. 5 illustrate another embodiment of a shroud assembly.

FIG. 1 illustrates an exemplary embodiment of a shroud assembly 100. FIG. 2 is a cross-sectional view of the shroud assembly 100 of FIG. 1. FIG. 3 is an end view of the shroud assembly 100. In this embodiment, the shroud assembly 100 is used to protect a jumper tube assembly 102 for coupling shunt tubes 106A, 106B attached to a tubular string, such as a screen 105. The shroud assembly 100 includes two semi-cylindrical covers 111, 112 having a first end attachable to a first receiver ring 121 and a second end attachable to a second receiver ring 122. In one example, the two covers 111, 112 are attached to the receiver rings 121, 122 using a pin connection, as shown in FIG. 1. In another example, the two covers are attached to the receiver rings using a dovetail connection, as shown in FIG. 5 as will be described below.

As shown in FIG. 1, each cover 111, 112 includes one or more pins 125 extending out of each end. For example, three pins 125 extend out of each end of each cover 111, 112. The pins 125 engage a respective slot 135 formed on the exterior surface of the receiver rings 121, 122. In one embodiment, the first receiver ring 121 is fixed relative to the screen 105. The second receiver ring 122 is movable relative to the screen 105 and toward the first receiver ring 121. In one embodiment, a plurality of pins 125 are circumferentially spaced around each cover 111, 112. As shown in FIG. 1, three pins 125 are disposed at each end of the covers 111, 112. In some embodiments, the pins 125 are spaced sufficiently such that the covers 111, 112 cannot move radially away from the receiver rings 121, 122. In this respect, the covers 111, 112 are attached to the receiver rings 121, 122 as long as the pins 125 are in the slots 135 of the receiver rings 121, 122.

The shroud assembly 100 also includes a base ring 140 and an extender ring 150. The base ring 140 is attached to the screen 105 and includes grooves 142 to accommodate the shunt tubes 106A. In this example, the base ring 140 includes a bore 144 for holding the screen 105, and both grooves 142 are formed less than 180 degrees apart. The screen bore 144 is an eccentric bore relative to a central axis of the base ring 140. One end of the extender ring 150 is threadedly coupled to the base ring 140, and the other end of the extender ring 150 abuts the second receiver ring 122. The extender ring 150 is configured to move the second receiver ring 122 toward the first receiver ring 121. In one example, the rotation of the extender ring 150 relative to the base ring 140 causes axial movement of the second receiver ring 122 away from the base ring 140 and toward the first receiver ring 121. In one embodiment, a torque key 160 extends from a slot 146 in the base ring 140 to a slot in the second receiver ring 122. The second receiver ring 122 moves axially relative to the torque key 160.

Figure 4:
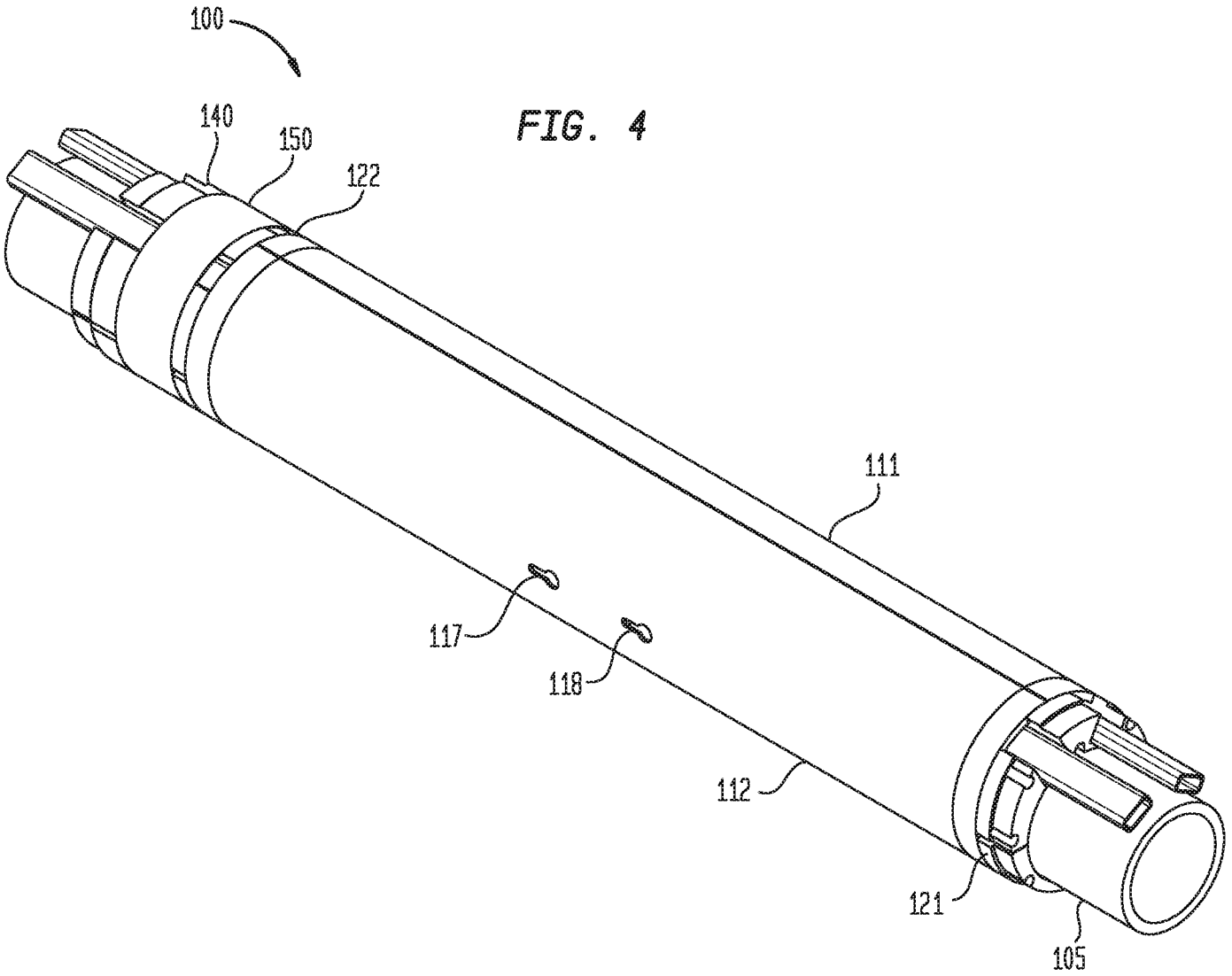
FIG. 4 shows the shroud assembly assembled on the screen.

During assembly, the pins 125 of the covers 111, 112 are aligned with the respective slots 135 of the first and second receiver rings 121, 122. In this example, the pins 125 at one end are aligned with the slots 135 of the first receiver ring 121 and then inserted to at least partially overlap with the slots 135 of the first receiver ring 121. Thereafter, the extender ring 150 is rotated relative to the base ring 140 to urge the second receiver ring 122 toward the first receiver ring. During movement, the pins 125 at the other end of the cover 111, 121 are aligned and inserted into the slots 135 of the second receiver ring 122. The extender ring 150 may be rotated until the pins 125 of the covers 111, 112 are prevented from axially moving out of disengagement with one of the slots 135. In one example, the second receiver ring 122 are moved toward the first receiver ring 121 until the covers 111, 121 cannot move axially relative to the first receiver ring 121, thereby locking the covers 111, 112 in position. FIG. 4 shows the shroud assembly 100 assembled on the screen 105. In some embodiments, the covers 111, 112 can be attached to the first and second receiver rings 121, 122 using a suitable fastener. Optionally, holder openings 117, 118 may be formed in each of the covers 111, 112 for connection to a handle to facilitate handling of the covers 111, 112.

Figure 6:
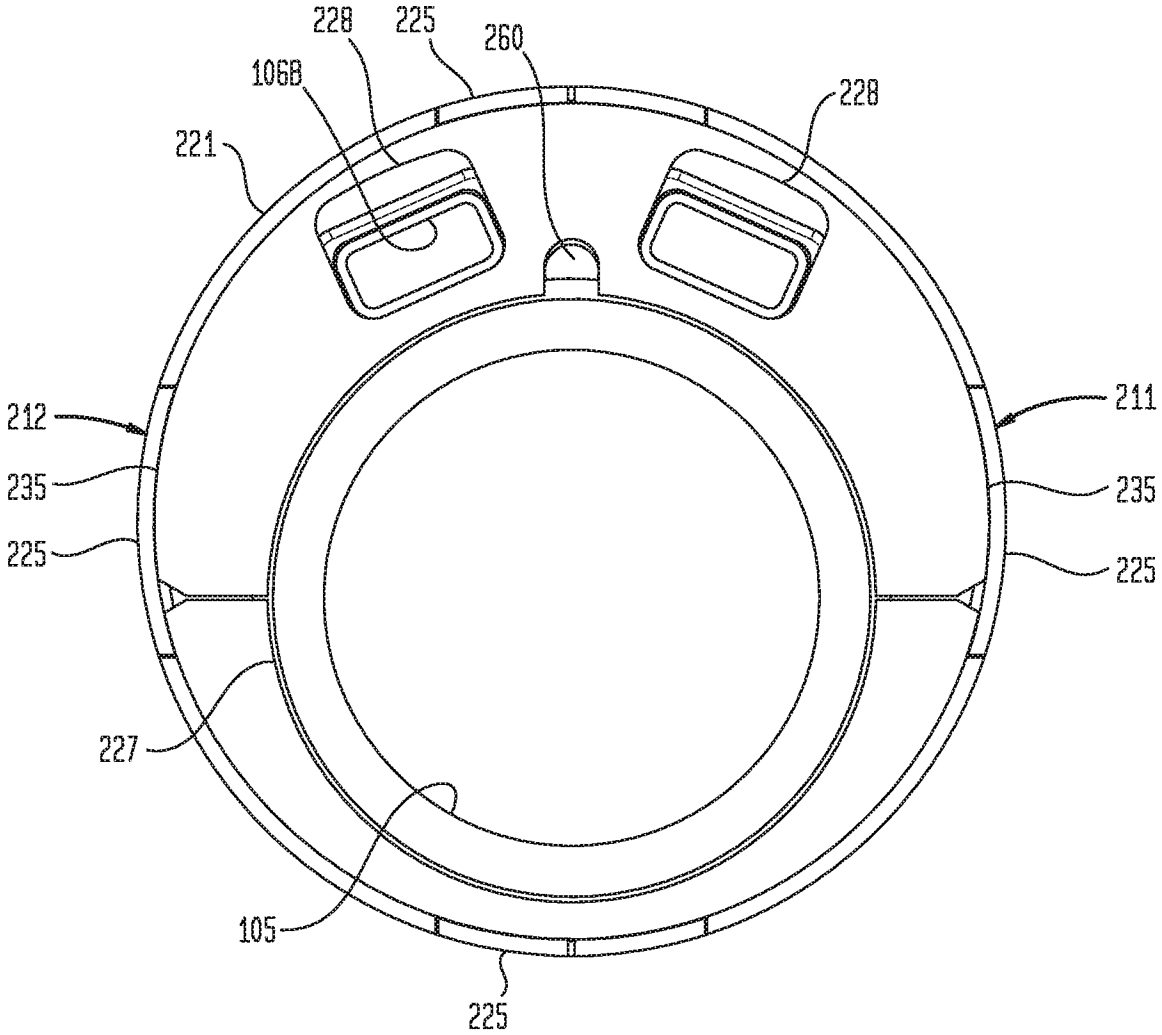
FIG. 6 is an end view of the shroud assembly.
Figure 7:
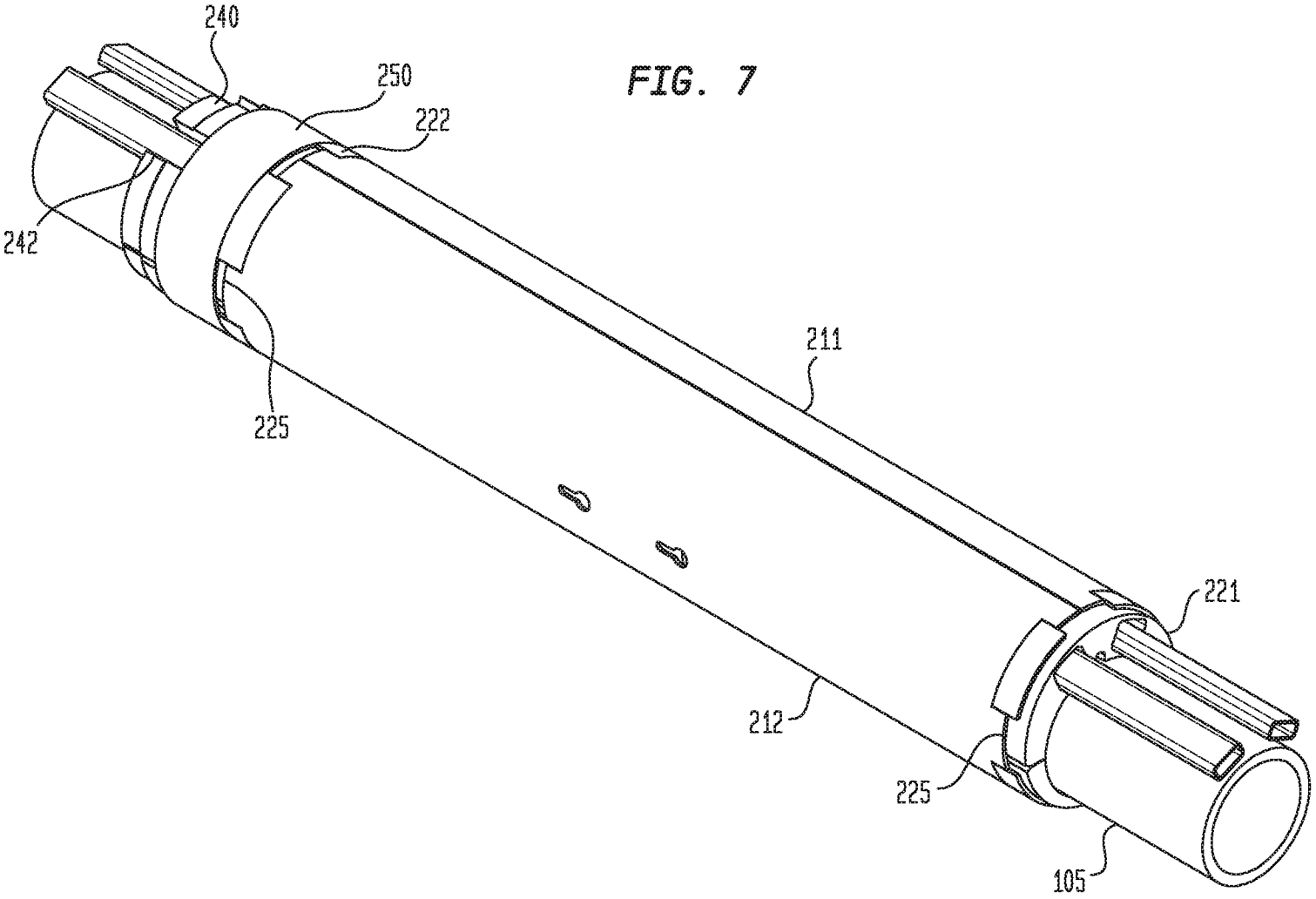
FIG. 7 shows the shroud assembly assembled on the screen.

FIG. 5 illustrates another embodiment of a shroud assembly 200. FIG. 6 is an end view of the shroud assembly 200. FIG. 7 is a perspective of the shroud assembly 200 installed on a tubular string. The shroud assembly 200 is used to protect a jumper tube assembly 102 for coupling shunt tubes 106A, 106B attached to a tubular string, such as a screen 105. In this embodiment, the shroud assembly 200 uses a dovetail connection for coupling the covers 211, 212 to the receiver rings 221, 222. The shroud assembly 200 includes two semi-cylindrical covers 211, 212 having a first end attachable to a first receiver ring 221 and a second end attachable to a second receiver ring 222. Each receiver ring 221, 222 includes a bore 227 to house the screen 105 and includes shunt bores 228 to accommodate the shunt tubes 106A, 106B. In this example, both shunt bores 228 are formed less than 180 degrees apart. The screen bore 227 is an eccentric bore relative to a central axis of the receiver rings 221, 222.

As shown in FIG. 5, each cover 211, 212 includes one or more dovetails 225 extending out of each end. For example, three dovetails 225 extend out of each end of each cover 211, 212. The dovetails 225 engage a respective slot 235 formed on the exterior surface of the receiver rings 221, 222. In one embodiment, the first receiver ring 221 is fixed relative to the screen 105. The second receiver ring 222 is movable relative to the screen 105 and toward the first receiver ring 221. In one embodiment, a plurality of dovetails 225 are circumferentially spaced around each cover 211, 212. As shown in FIG. 5, three dovetails 225 are disposed at each end of the covers 211, 212. In some embodiments, the dovetails 225 are spaced apart sufficiently such that the covers 211, 212 cannot move radially away from the receiver rings 221, 222. In this respect, the covers 211, 212 are attached to the receiver rings 221, 222 as long as the dovetails 225 are in the slots 235 of the receiver rings 221, 222 and cannot move axially out of engagement with the slots 235. In this example, a dovetail 225 is located at opposite edges of the end of the cover 111, 112. In some embodiments, the dovetails 225 at located at the edges are smaller in width than the dovetail 225 located between them.

The shroud assembly 200 also includes a base ring 240 and an extender ring 250. The base ring 240 is attached to the screen 105 and includes grooves 242 to accommodate the shunt tubes 106A. In this example, the base ring 240 includes a bore for holding the screen 105, and both grooves 242 are formed less than 180 degrees apart. The screen bore is an eccentric bore relative to a central axis of the base ring 240. One end of the extender ring 250 is threadedly coupled to the base ring 240, and the other end of the extender ring 250 abuts the second receiver ring 222. The extender ring 250 is configured to move the second receiver ring 222 toward the first receiver ring 221. In one example, the rotation of the extender ring 250 relative to the base ring 240 causes axial movement of the second receiver ring 222 away from the base ring 240 and toward the first receiver ring 221. In one embodiment, a torque key 260 extends from a slot in the base ring 240 to a slot in the second receiver ring 222. The second receiver ring 222 moves axially relative to the torque key 260.

During assembly, the dovetails 225 of the covers 211, 212 are aligned with the respective slots 235 of the first and second receiver rings 221, 222. In this example, the dovetails 225 at one end are aligned with the slots 235 of the first receiver ring 221 and then inserted to at least partially overlap with the slots 235 of the first receiver ring 221. Also, the dovetails 225 at the other end of the cover 211, 221 are aligned and inserted into the slots 235 of the second receiver ring 222. Thereafter, the extender ring 250 is rotated relative to the base ring 240 to urge the second receiver ring 222 toward the first receiver ring. The extender ring 250 may be rotated until the dovetails 225 of the covers 211, 212 are prevented from axially moving out of disengagement with one of the slots 235. In one example, the second receiver ring 222 are moved toward the first receiver ring 221 until the covers 211, 221 cannot move axially relative to the first receiver ring 221, thereby locking the covers 211, 212 in position. FIG. 7 shows the shroud assembly 200 assembled on the screen 105. In some embodiments, the covers 211, 212 can be attached to the first and second receiver rings 221, 222 using a suitable fastener.

Figure 8:
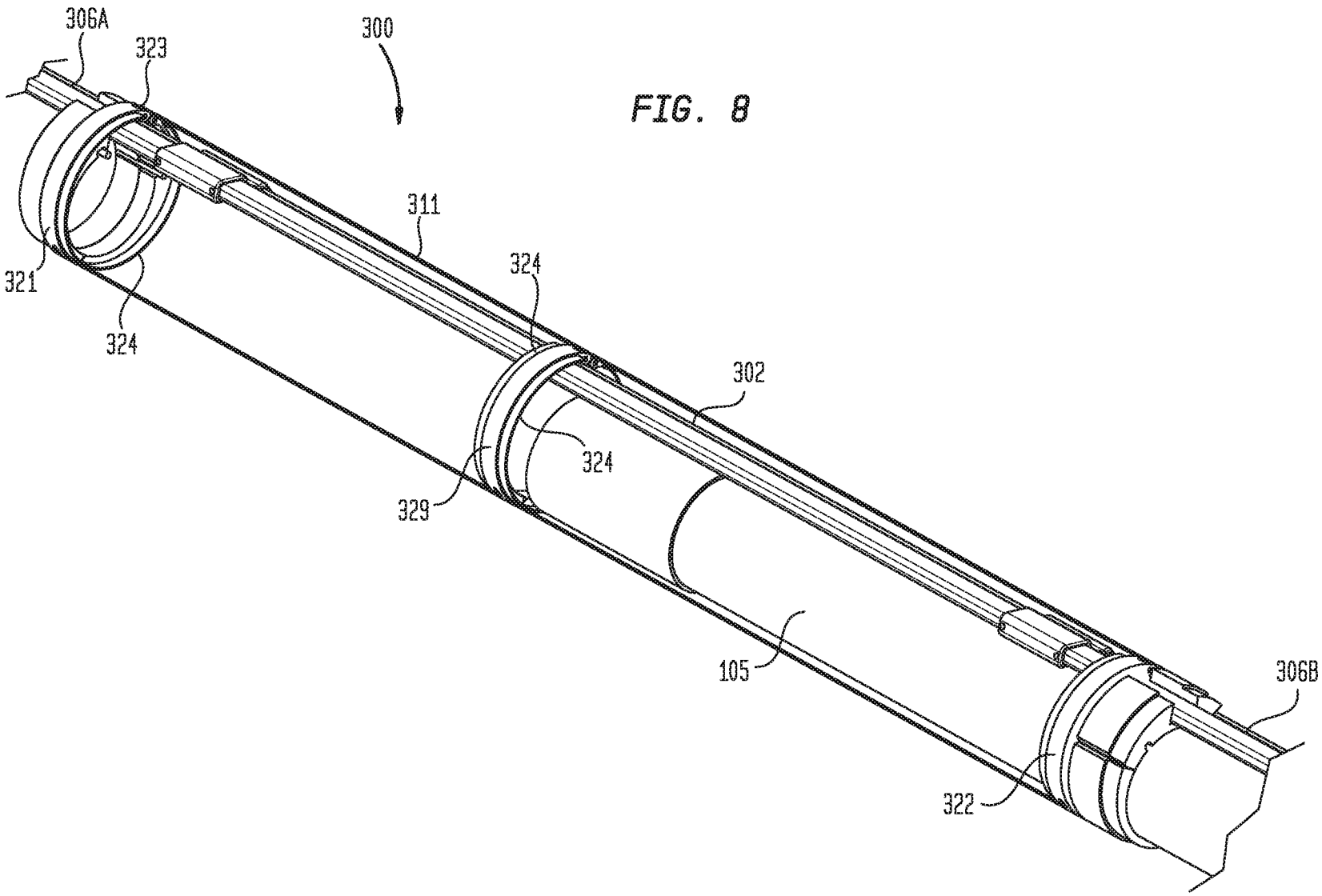
FIG. 8 illustrates another exemplary embodiment of a shroud assembly.
Figure 9:
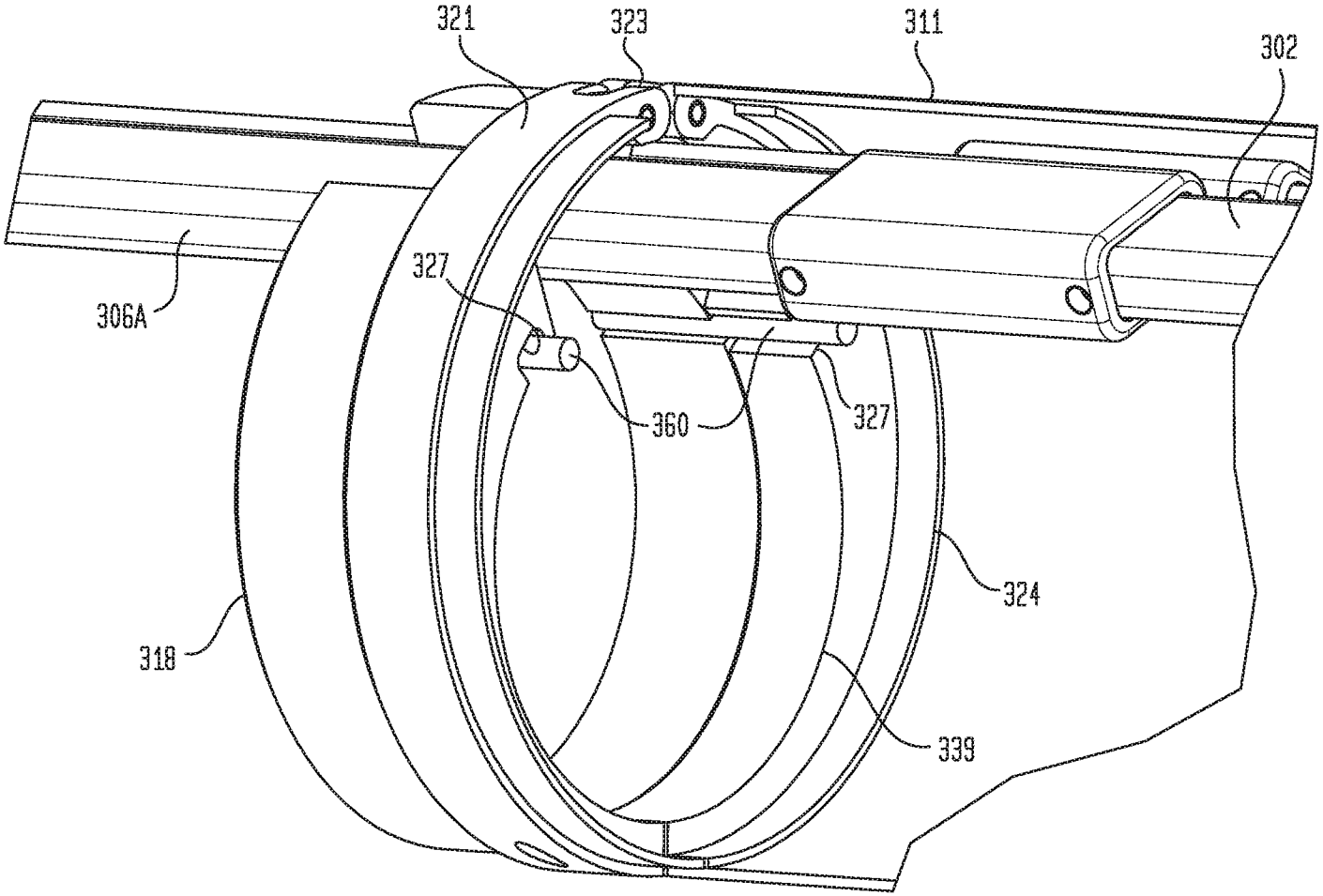
FIG. 9 is an enlarged partial view of the shroud assembly.
Figure 10:
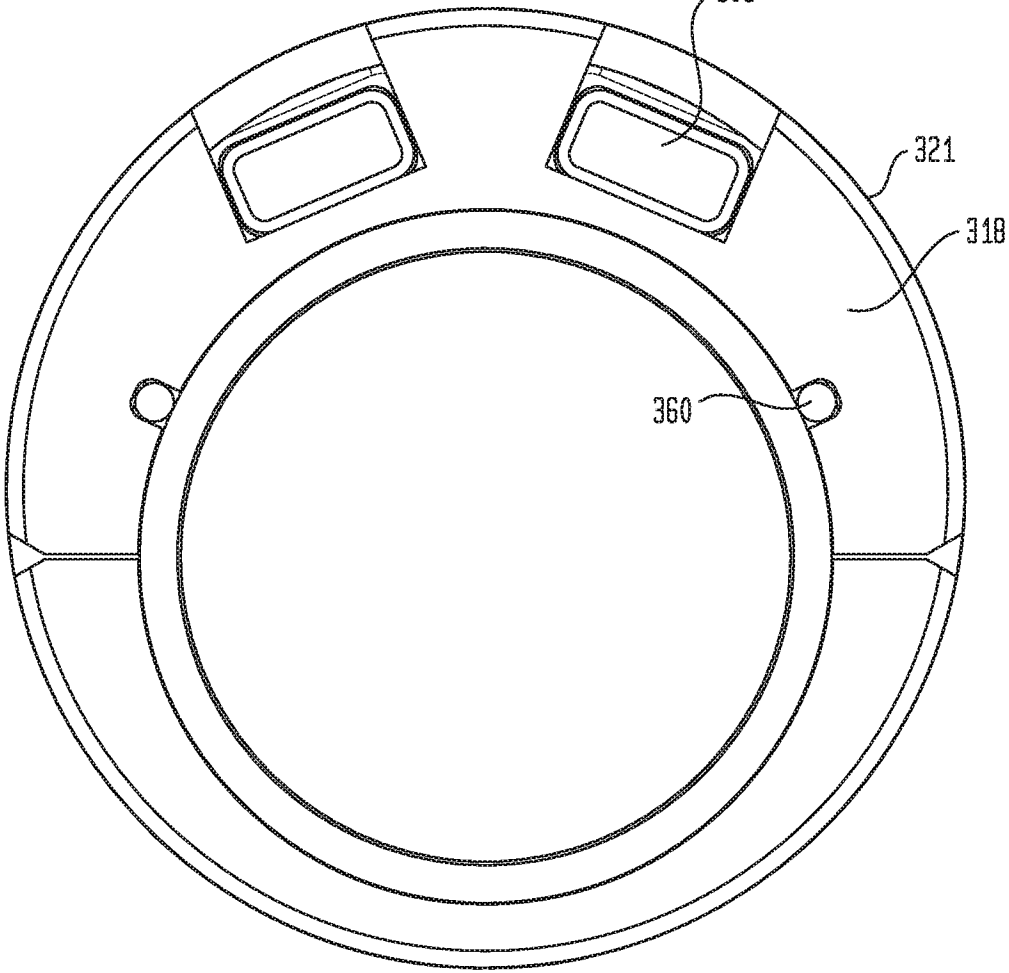
FIG. 10 is an end view of the shroud assembly.
Figure 11:
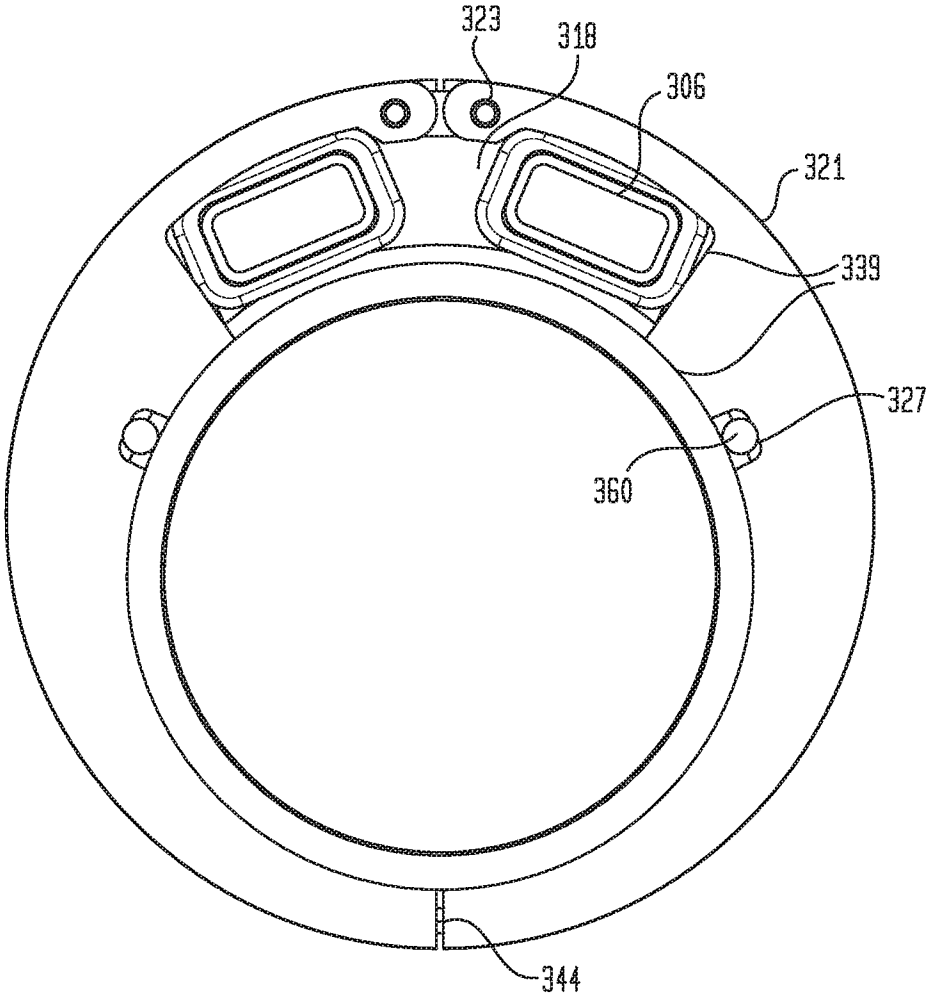
FIG. 11 is a cross-sectional view of the shroud assembly of FIG. 8.

FIG. 8 illustrates another exemplary embodiment of a shroud assembly 300. FIG. 9 is an enlarged partial view of the shroud assembly 300. FIG. 10 is an end view of the shroud assembly 300. FIG. 11 is a cross-sectional view of the receiver ring of the shroud assembly 300 of FIG. 8. In this embodiment, the shroud assembly 300 is used to protect a jumper tube assembly 302 for coupling shunt tubes 306 attached to a tubular string, such as a screen 105. The shroud assembly 300 includes two semi-cylindrical covers 311 (only one shown for clarity) having a first end attached to a first receiver ring 321 and a second end attachable to a second receiver ring 322. The receiver rings 321, 322 are made of two semi-circular halves that are pivotally coupled to each other using a hinge 323. The receiver rings 321, 322 have an inner profile 339 configured to accommodate the screen 105 and the shunt tubes 306A, 306B. In the example shown in FIG. 9, the inner profile 339 accommodating the screen 105 and the shunt tubes 306 is contiguous. The covers 311, 312 are attached to a flange 324 of the receiver rings 321, 322. In one example, the flange 324 is formed by welding a flange ring to the receiver ring 321, 322. The two halve of the receiver rings 321, 322 may be locked together using a fastener 344, such as a screw, a self-retaining mechanism, a bolt, or other suitable fasteners. In some embodiments, the flange can be machined on the receiving ring.

The first receiver ring 321 may be positioned adjacent a base ring 318 attached to the screen 105. One or more torque keys 360 extend from a slot in the base ring 318 to a slot 327 in the first receiver ring 322. FIG. 9 shows two torque keys 360 coupling the receiver ring 321 to the base ring 318.

In one embodiment, an intermediate receiver ring 329 may be used to extend the length of the shroud assembly 300. In the FIG. 8, the intermediate receiver ring 329 has a flange 324 on both ends. The flanges 324 allow a cover 311 to be attached to each end of the intermediate receiver ring 329.

Embodiments of the shroud assembly described herein are suitable for protecting other downhole devices. For example, the shroud assembly can be used to protect a wire, cable, coil, electronic devices, and other downhole devices.

In some embodiments, the nozzles on the shunt tubes may be configured to control the pressure drop along the length of the shunt tubes. In general, the shunt tubes transport the slurry along the screen. The nozzles of the shunt tubes are used to eject the slurry out into the annular area between the screen and the wellbore. In some embodiments, the total amount of fluid outflow at each joint or group of joints is different.

Figure 12:
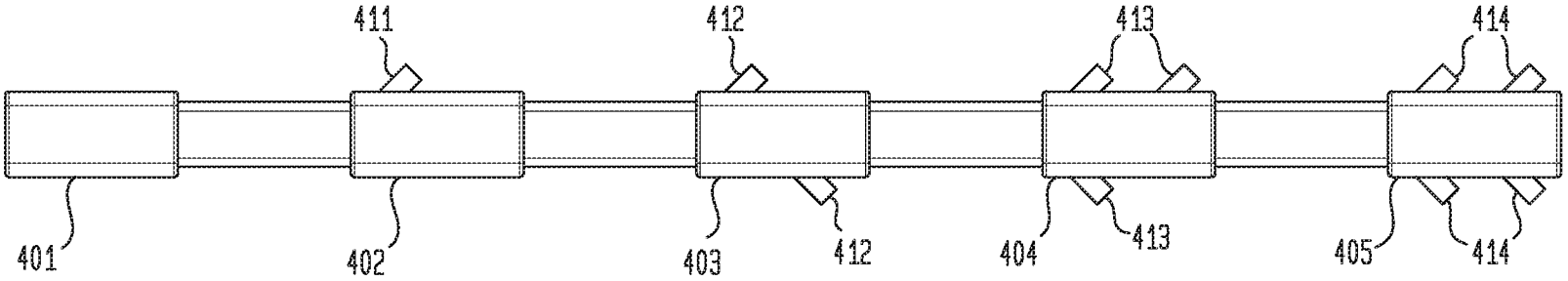
FIG. 12 illustrate an arrangement of nozzles on a shunt tube string, according to one embodiment.

FIG. 12 shows a shunt tube having a plurality of joints 401-405, according to one embodiment. Each joint 401-405 of the shunt tube may have a different number of nozzles 411-414. In particular, the number of nozzles increases as the shunt tube extend deeper into the wellbore. In one specific example, a first upper joint may have X number of nozzles, and the next joint may have one more nozzle, i.e., X+1 nozzles. The third joint down may have two more nozzles. It is contemplated that the number of nozzles on the subsequent joint may increase by more than 1, such as by, 2, 3, 4, 5, or 10 nozzles. In this example, the uppermost joint, joint 401, does not have any nozzles. The next joint, joint 402, has a single nozzle 411. Joint 403 has two nozzles 412, and joint 404 has three nozzles 413. The lowermost joint, joint 405, has four nozzles 414.

Figure 13:
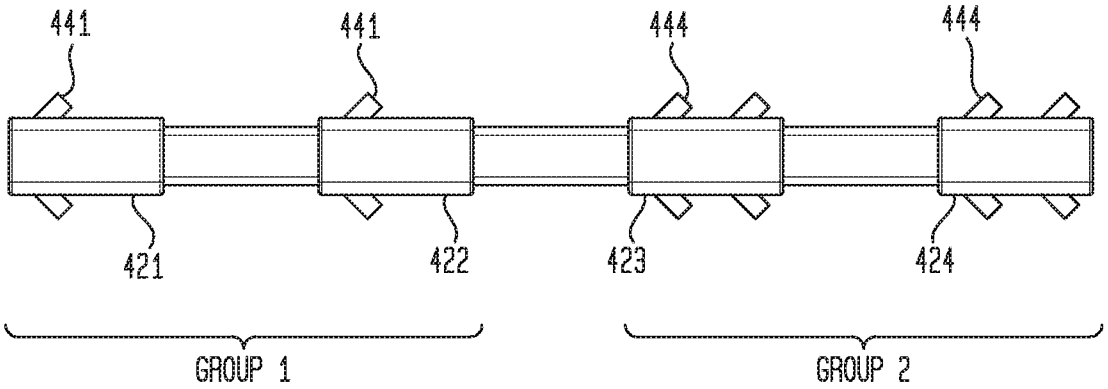
FIG. 13 illustrate another arrangement of nozzles on a shunt tube string, according to one embodiment.

In another embodiment, a group of joints may have the same number of nozzles, while the next group of joints may have more or less nozzles. For example, a group of Z joints may have Y number of nozzles, and the next group of Z joints may each have 2 more or fewer nozzles. In the example of FIG. 13, group 1 includes joints 421 and 422. Each of these joints has 2 nozzles 441. Group 2 includes joints 423 and 424, each of which has 4 nozzles 444.

In another embodiment, the size of the nozzles may increase as the shunt tubes extend deeper into the wellbore. In yet another embodiment, the size of the nozzles increase, while the number of nozzles remains the same as the shunt tubes extend deeper into the wellbore. In yet another embodiment, the size and/or the number of nozzles may change as the shunt tubes extend deeper into the wellbore.

In another embodiment, the spacing of the nozzles may change as the shunt tubes extend deeper into the wellbore. For example, the spacing of nozzles may decrease as the shunt tubes extend deeper into the wellbore.

In some embodiments, a tubular string assembly includes a plurality of receiver rings; a tubular string disposed through the plurality of receiver rings; a shunt tube assembly supported by the plurality of receiver rings, the shunt tube assembly including a jumper tube assembly; and two semi-cylindrical covers disposed attached to the plurality of receiver rings and enclosed around the tubular string.

In one or more of the embodiments described herein, the assembly includes an extender ring configured to move a first receiver ring toward a second receiver ring.

In one or more of the embodiments described herein, wherein the covers enclose the jumper tube assembly.

In one embodiment, a shroud assembly includes two semi-cylindrical covers having a connector at each end; a plurality of receiver rings for supporting the covers and engaging the connector; and an extender ring configured to move a first receiver ring toward a second receiver ring.

In one or more of the embodiments described herein, the assembly includes a base ring coupled to the extender ring.

In one or more of the embodiments described herein, the extender ring is rotatable relative to the base ring.

In one or more of the embodiments described herein, the extender ring is disposed between the base ring and the first receiver ring.

In one or more of the embodiments described herein, the first receiver ring is axially movable relative to the base ring.

In one or more of the embodiments described herein, the assembly includes a torque key coupled to the base ring and the first receiver ring.

In one or more of the embodiments described herein, the plurality of receiver rings include a slot for engaging the connector.

In one or more of the embodiments described herein, the connector is moved axially into engagement with the slot.

In one or more of the embodiments described herein, the covers cannot move radially relative to the plurality of receiver rings.

In one or more of the embodiments described herein, the connector comprises a plurality of pins.

In one or more of the embodiments described herein, the connector comprises a plurality of dovetails.

In one or more of the embodiments described herein, the shroud assembly encloses a device selected from the group consisting of a shunt tube, a wire, a cable, a coil, an electronic devices, and combinations thereof.

In some embodiments, a shroud assembly includes a plurality of receiver rings, each ring having two portions pivotally coupled to each other; two semi-cylindrical covers attached to the plurality of receiver rings; and a fastener for locking the two portions together.

In one or more of the embodiments described herein, the plurality of receiver rings include a flange for attaching the covers.

In one or more of the embodiments described herein, the flange is formed by attaching a flange ring to the plurality of receiver rings.

In one or more of the embodiments described herein, the flange is machined onto the plurality of receiver rings.

In one or more of the embodiments described herein, the plurality of receiver rings include an inner profile for accommodating a screen and a tube.

In one or more of the embodiments described herein, the assembly includes a base ring rotationally fixed relative to the plurality of receiver rings.

In some embodiments, a shunt tube assembly includes a plurality of joints of shunt tube, each of the joints include at least one nozzle, wherein a first joint located adjacent to a second joint has a different fluid outflow than the second joint.

In one or more of the embodiments described herein, the first joint and the second joint have a different number of nozzles.

In one or more of the embodiments described herein, three adjacent joints have a different number of nozzles.

In one or more of the embodiments described herein, the number of nozzles increases with respect to the joints in descending order.

In one or more of the embodiments described herein, a third joint located adjacent to the second joint has the same number of nozzles as the second joint.

In one or more of the embodiments described herein, a size of a nozzle of the first joint is different from a size of a nozzle of the second joint.

While the foregoing is directed to embodiments of the present invention, other and further embodiments of the invention may be devised without departing from the basic scope thereof, and the scope thereof is determined by the claims that follow.

The invention claimed is:

1. A shroud assembly, comprising:

two semi-cylindrical covers having a connector at each end;

a plurality of receiver rings for supporting the covers and engaging the connector; and an extender ring coupled to a base ring, and configured to move a first receiver ring of the plurality of receiver rings axially relative to the base ring toward a second receiver ring of the plurality of receiver rings.

2. The assembly of claim 1, wherein the extender ring is rotatable relative to the base ring.

3. The assembly of claim 2, wherein the extender ring is disposed between the base ring and the first receiver ring.

4. The assembly of claim 1, further comprising a torque key coupled to the base ring and the first receiver ring.

5. The assembly of claim 1, wherein the plurality of receiver rings include a slot for engaging the connector.

6. The assembly of claim 5, wherein the connector is moved axially into engagement with the slot.

7. The assembly of claim 5, wherein the covers cannot move radially relative to the plurality of receiver rings.

8. The assembly of claim 1, wherein the connector comprises a plurality of pins.

9. The assembly of claim 1, wherein the connector comprises a plurality of dovetails.

10. The assembly of claim 1, wherein the shroud assembly encloses a device selected from the group consisting of a shunt tube, a wire, a cable, a coil, an electronic device, and combinations thereof.

11. A shroud assembly, comprising:

a plurality of receiver rings, each receiver ring having two portions pivotally coupled to each other;

two semi-cylindrical covers attached to the plurality of receiver rings;

a fastener for locking the two portions together;

a base ring, a first receiver ring of the plurality of receiver rings axially movable with respect to the base ring; and a torque key coupled to the base ring and the first receiver ring.

12. The assembly of claim 11, wherein the plurality of receiver rings include a flange for attaching the covers.

13. The assembly of claim 11, wherein the base ring is rotationally fixed relative to the plurality of receiver rings.

14. The assembly of claim 11, further comprising an extender ring coupled to the base ring, and configured to move the first receiver ring toward a second receiver ring of the plurality of receiver rings.

15. The assembly of claim 14, wherein the extender ring is rotatable relative to the base ring.

* * * * *